United States Patent [19]

Masaki

[11] Patent Number: 4,644,229

[45] Date of Patent: Feb. 17, 1987

[54] POWER SUPPLY FOR LIGHTING INCANDESCENT LAMP WTH HIGH-BRIGHTNESS

[75] Inventor: Kazumi Masaki, Osaka, Japan

[73] Assignee: Ken Hayashibara, Okayama, Japan

[21] Appl. No.: 610,254

[22] Filed: May 14, 1984

[30] Foreign Application Priority Data

May 21, 1983 [JP] Japan ..... 58-89837

[51] Int. Cl.[4] ..... H05B 37/02; G05F 1/00

[52] U.S. Cl. ..... 315/310; 315/209 R; 315/311; 323/238; 323/321; 361/51

[58] Field of Search ..... 315/309, 310, 311, 205, 315/209 R; 361/58; 323/238, 321

[56] References Cited

U.S. PATENT DOCUMENTS

| | | | |
|---|---|---|---|
| 1,778,416 | 10/1930 | Buttolph | 315/310 |
| 3,112,435 | 11/1963 | Barney | 361/58 |
| 3,529,210 | 9/1970 | Toshio Ito et al. | 361/58 |
| 3,935,511 | 1/1976 | Boulanger et al. | 361/58 |
| 3,975,658 | 8/1976 | Emtage et al. | 315/311 |
| 4,008,416 | 2/1977 | Nakasone | 323/321 |
| 4,423,478 | 12/1983 | Bullock et al. | 323/238 |
| 4,503,365 | 3/1985 | Kirk | 315/310 |

FOREIGN PATENT DOCUMENTS

| | | | |
|---|---|---|---|
| 1589663 | 5/1981 | United Kingdom | 363/49 |

*Primary Examiner*—Harold Dixon

*Attorney, Agent, or Firm*—Browdy and Neimark

[57] ABSTRACT

The present invention provides a power supply for lighting an incandescent lamp with high-brightness, comprising connecting a time constant circuit, rectifier, switching device so that the output of the rectifier is supplied to an incandescent lamp through the impedance for a period, determined by the time constant circuit, and that the switching device conducts and shorts the impedance after a lapse of the period to allow the incandescent lamp to receive the output of the rectifier by bypassing the impedance.

4 Claims, 6 Drawing Figures

POWER SUPPLY FOR LIGHTING INCANDESCENT LAMP WTH HIGH-BRIGHTNESS

FIELD OF THE INVENTION

The present invention relates to a power supply. More particularly, it relates to a power supply which can light an incandescent lamp with high-brightness.

BACKGROUND OF THE INVENTION

In an incandescent lamp equipped with a filament, such as tungsten filament, the resistance of a non-lighted filament is extremely lower, generally, about one-tenth, than that in an incandescent state. For example, the resistance of a 100 watt incandescent lamp is about 100 ohms when lighted, whereas its resistance is less than 10 ohms when non-lighted. Since the peak magnitude of ac 100 volt lamp wire goes up to 141 volts, the incandescent lamp inevitably receives a 14 amperes of inrush-current when it is coupled with the lamp wire at the peak magnitude. Accordingly, such inrush-current would be a major factor of causing filament snapping.

OBJECT OF THE INVENTION

The present invention is intended to decrease the occurrence of inrush-current into an incandescent lamp by connecting an impedance with the incandescent lamp in series so that the incandescent lamp receives an ac current through the impedance when switched on until its filament is sufficiently heated, and so that the impedance is shorted when the filament is sufficiently heated.

Now, the present invention is explained with devices using ac 100 volt lamp wire, but should be practiced in various cases using other lamp wires, regardless of their frequency or voltage.

DETAILED DESCRIPTION OF THE INVENTION

In FIGS. 1 through 5, S shows switch or a contact of relay; R, resistance; C, capacitance; T, transformer; DCR, bidirectional triode thyristor; D, diode or diode bridge; L, relay; and Z, incandescent lamp.

In FIG. I, when power switch $S_1$ is turned on, an ac current flows to the return circuit through resistance R, diode bridge D and incandescent lamp Z, to charge capacitance $C_2$ and also to light incandescent lamp Z. Simultaneously, the ac current generated at the secondary coil of transformer T charges capacitance $C_1$ through diode bridge $D_1$. After a prescribed time, a dc signal is supplied to the gate of bidirectional triode thyristor DCR through resistance $R_1$, and thyristor DCR conducts to short series resistance R. Thus, incandescent lamp Z receives the full output of diode bridge D.

Figure 6:
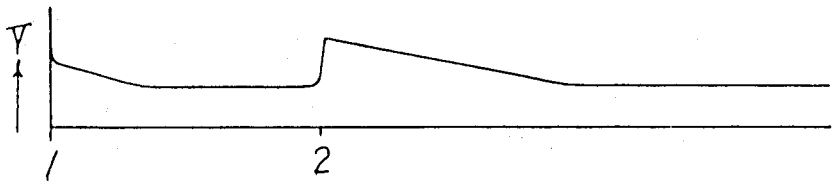
FIG. 6 shows the time-course of voltage in the circuit given in FIGS. 1, 2, 3, 4, or 5.

Support that a 100 watt incandescent lamp Z is coupled to an ac power supply. Since its resistance in non-lighted state is about 10 ohms, the incandescent lamp inevitably receives an inrush-current of 14 amperes when the ac power supply is coupled to the incandescent lamp at its peak magnitude. If series resistance R is set to 60 ohms and connected with the incandescent lamp in series, 2 amperes of ac current comes into flow because the total resistance of the circuit is 70 ohms. The inflow of 2 amperes of ac current brings the incandescent lamp into red heat state. At the same time, the conduction of thyristor DCR shorts the series resistance, and permits the full-power lighting of the incandescent lamp. The time-course of the voltage in the circuit is given in FIG. 6, wherein the symbol "1" shows the moment where power switch $S_1$ is closed; and the symbol "2", the moment where series resistance R is shorted. The time interval from "1" to "2" can be freely shortened or prolonged by changing the circuit constants of the time constant circuit consisting of capacitance $C_1$ and resistance $R_1$; generally, 5–10 cycles in terms of the frequency of a 60 Hz ac power source. In the circuit given in FIG. 1, the insertion of high capacitance $C_2$ and charging resistance $R_3$ between the diode bridge is intended to prevent the occurrence of an electric spark by inflow of an excessive current which may be generated upon switching of switch $S_2$.

Figure 2:
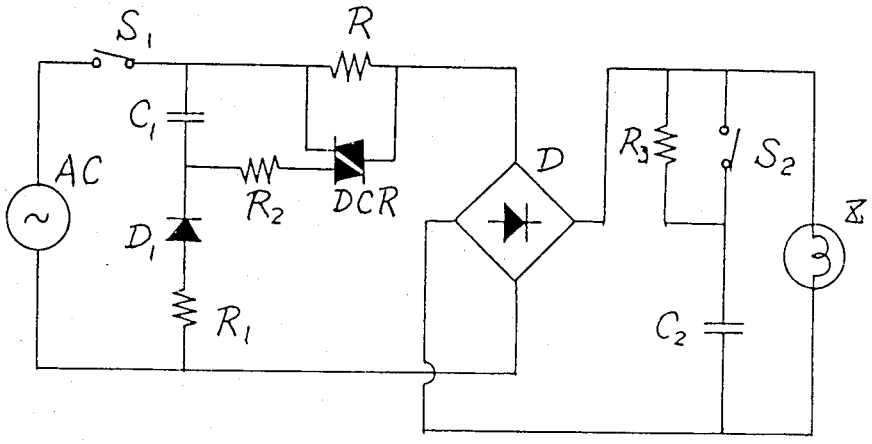
FIG. 2 shows a circuit wherein a bidirectional triode thyristor is driven with a current which is obtained by directly rectifying an ac power source.

FIG. 2 shows another embodiment according to the invention, wherein transformer T is omitted. In this circuit, an ac current through resistance $R_1$ is rectified by diode $D_1$, and the discharge of capacitance $C_1$ in the time constant circuit is supplied to the gate of thyristor DCR.

Figure 3:
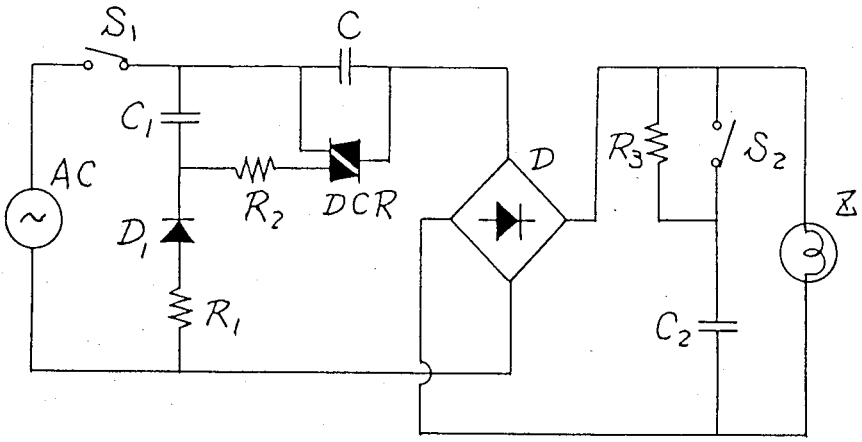
FIG. 3 shows a circuit using a capacitance in place of the series resistance.

FIG. 3 shows a further embodiment according to the invention, wherein non-polar capacitance C is replaced for the series resistance. The non-polar capacitance C gives an impedance approximately equal to that calculated by the equation of $R=\frac{1}{2}\pi fC$, where f is the frequency of ac power supply.

Figure 1:
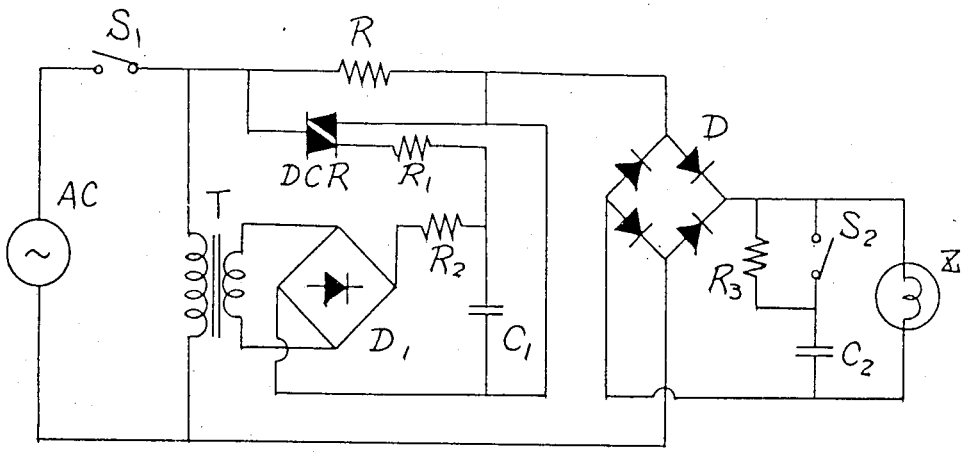
FIG. 1 shows a circuit wherein a series resistance is shorted by a bidirectional triode thyristor which is driven by a power supply using a transformer.
Figure 4:
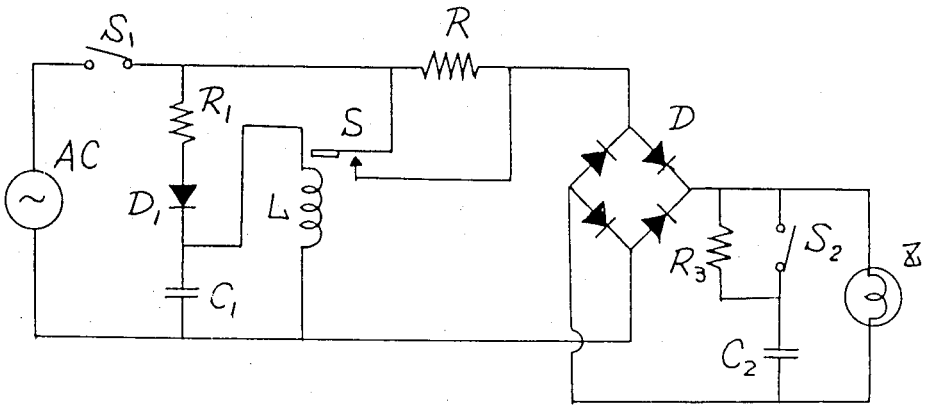
FIG. 4 shows a circuit wherein a relay is used for the purpose of shorting a series resistance.

FIG. 4 shows a further embodiment according to the invention using contact S of relay L in place of bidirectional triode thyristor DCR in FIGS. 1, 2, and 3. In this circuit, a current from resistance $R_1$ is rectified by diode $D_1$, and charges capacitance $C_1$. After a lapse of a prescribed time, the discharge current of capacitance $C_1$ flows into the coil of relay L to short series resistance R. Series resistance R may be replaced with a capacitance, similarly as in the FIG. 3 circuit.

Figure 5:
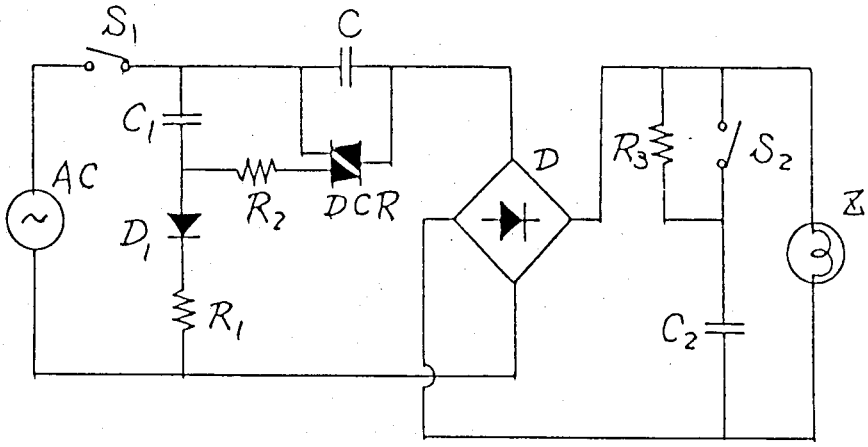
FIG. 5 shows a circuit wherein an ac power source is rectified by a diode bridge to obtain a dc current which drives the whole circuit including time constant circuit and an incandescent lamp.

FIG. 5 shows an additional embodiment wherein an ac source is first rectified by diode bridge $D_1$ to obtain a dc current which then drives bidirectional triode thyristor DCR to short series resistance R. In this circuit, a dc voltage is applied to the gate of thyristor DCR through resistance $R_2$ and triggered the thyristor after a lapse of a prescribed time, determined by the time constant circuit consisting of resistance $R_1$ and capacitance $C_1$, to short series resistance R.

As is apparent from the above, the power supply according to the invention effectively prevents the occurrence of inrush-current into an incandescent lamp upon switching-on. Since the circuit constants of the present power supply can be suitably changed to meet the voltage and frequency of a lamp wire to be used as well as to meet the rating of an incandescent lamp, any incandescent lamp is operable with the use of the present power supply as long as the incandescent lamp uses a filament means. Thus, in addition to incandescent lamp using tungsten filament, other incandescent lamp directed to a special use may be operable with the present power supply: Examples of such incandescent lamp are those for street lamp, gate lamp, lounge, microscope, vehicle, advertising lights, and signal lamp. Furthermore, the present power supply provides a dc energy, a light source for a high-speed camera is also operable therewith.

It is further understood by those skilled in the art that the foregoing description is a preferred embodiment according to the invention and that various changes and modifications may be made in the invention without departing from the spirit and scope thereof.

I claim:

1. An electric circuit for supplying rectified single-phase alternating current to an incandescent lamp having a low cold filament resistance that increases when energized, said circuit comprising:

(a) first and second terminals for receiving an AC source;

(b) a three electrode, bidirectional triode thyristor having a conduction mode and a non-conduction mode, and having a first electrode connected to the first terminal;

(c) an RC time constant circuit energized from the AC source, and connected for controlling the third electrode of said bidirectional triode thyristor;

(d) an impedance, having a higher impedance than said cold filament resistance of said incandescent lamp, connected in parallel with said bidirectional triode thyristor, said impedance being short circuited when said bidirectional triode is in said conduction mode;

(e) means including rectifying means, connected in series with said impedance and said incandescent lamp between said second electrode and said second terminal, for obtaining a DC current for the lamp; and (f) an RC charge circuit connected across said lamp to prevent sparking when switching.

2. The electric circuit of claim 1, wherein said impedance is a resistor having a higher resistance than said cold filament resistance of said incandescent lamp.

3. The electric circuit of claim 1, wherein said impedance is a capacitor having a higher impedance than said cold filament resistance of said incandescent lamp.

4. The electric circuit of claim 1, wherein said impedance is an inductor having a higher impedance than said cold filament resistance of said incandescent lamp.

* * * * *